US007833958B2

(12) United States Patent
Barbizan et al.

(10) Patent No.: US 7,833,958 B2
(45) Date of Patent: Nov. 16, 2010

(54) LAUNDRY TREATMENT COMPOSITIONS CONTAINING A FABRIC SOFTENER AND A BLUE OR VIOLET DYE

(75) Inventors: Danielle Santinho Barbizan, Sao Paulo SP (BR); Stephen Norman Batchelor, Bebington (GB); Lisanne Beatriz Grigolon, Sau Paulo SP (BR); Andrea Dias Sorze, Sao Paulo SP (BR); Andrew Thomas Steel, Bebington (GB)

(73) Assignee: Conopco, Inc., Englewood Cliffs, NJ (US)

( * ) Notice: Subject to any disclaimer, the term of this patent is extended or adjusted under 35 U.S.C. 154(b) by 0 days.

(21) Appl. No.: 12/495,868

(22) Filed: Jul. 1, 2009

(65) Prior Publication Data

US 2009/0264335 A1 Oct. 22, 2009

Related U.S. Application Data

(63) Continuation of application No. 10/561,563, filed on Jun. 8, 2006, now Pat. No. 7,569,531.

(30) Foreign Application Priority Data

Jun. 18, 2003 (GB) ..... 0314210.6

(51) Int. Cl.

| | |
|---|---|
| ***C11D 1/00*** | (2006.01) |
| ***C11D 3/40*** | (2006.01) |
| ***C11D 3/42*** | (2006.01) |
| ***D06P 1/02*** | (2006.01) |
| ***D06P 5/17*** | (2006.01) |

(52) U.S. Cl. ..... 510/276; 510/324; 510/327; 8/451; 8/636; 8/639; 8/662

(58) Field of Classification Search ..... 510/276, 510/324, 327; 8/451, 636, 639, 662
See application file for complete search history.

(56) References Cited

U.S. PATENT DOCUMENTS

| | | | | |
|---|---|---|---|---|
| 3,748,093 | A | 7/1973 | Gangwisch et al. | 8/137 |
| 3,755,201 | A * | 8/1973 | Trimmer et al. | 510/324 |
| 3,762,859 | A | 10/1973 | Wixon et al. | 8/18 |
| 3,950,276 | A | 4/1976 | Grand | 252/536 |
| 3,958,928 | A | 5/1976 | Lala | 8/25 |
| 4,238,192 | A | 12/1980 | Kandathil | 8/111 |
| 4,908,040 | A | 3/1990 | Naef et al. | 8/137 |
| 5,071,573 | A | 12/1991 | Coffindaffer et al. | 252/8.8 |
| 6,194,554 | B1 | 2/2001 | Mennicke et al. | 534/819 |
| 6,635,092 | B2 | 10/2003 | Käser et al. | 8/641 |
| 6,635,702 | B1 * | 10/2003 | Schmucker-Castner et al. | 524/291 |
| 7,205,269 | B2 | 4/2007 | Sadlowski et al. | 510/419 |
| 7,208,459 | B2 | 4/2007 | Sadlowski et al. | 510/419 |
| 2003/0192130 | A1 * | 10/2003 | Kaaret et al. | 8/115.51 |
| 2006/0205624 | A1 | 9/2006 | Hohener | 510/310 |

FOREIGN PATENT DOCUMENTS

| | | | |
|---|---|---|---|
| DE | 31 25 495 | | 5/1982 |
| EP | 138 410 | | 5/1987 |
| EP | 373 696 | | 6/1990 |
| EP | 373696 | * | 6/1990 |
| FR | 1 163 899 | | 5/1958 |
| GB | 1 247 189 | | 9/1971 |
| GB | 2 094 826 | | 9/1982 |
| GB | 2 165 550 | | 4/1986 |
| JP | 60 0051793 | | 3/1985 |
| JP | 7 102293 | | 4/1995 |
| WO | 90/15856 | | 12/1990 |
| WO | 98/08927 | | 3/1998 |
| WO | 02/00994 | | 1/2002 |
| WO | 03/014277 | | 2/2003 |
| WO | WO 03/014277 | * | 2/2003 |
| WO | 2004/003125 | | 1/2004 |
| WO | 2005/003275 | | 1/2005 |
| WO | 2005/014769 | | 2/2005 |
| WO | 2006/102984 | | 10/2006 |

OTHER PUBLICATIONS

Co-pending Application: Applicant: Batchelor et al., U.S. Appl. No. 10/561,660, filed Dec. 16, 2005.
Notice of Opposition to EP 1633842 by Procter & Gamble Company, Nov. 17, 2008.
GB Search Report in a GB application GB 0325619.5—Feb. 19, 2004.
GB Search Report in a GB application GB 0314210.6—Oct. 8, 2003.
PCT International Search Report in a PCT application PCT/EP 2004/006085—Sep. 4, 2004.
PCT International Search Report in a PCT application PCT/EP 2004/006087—Aug. 30, 2004.
Abstract of DE 31 25 495—published May 19, 1982.
Derwent Abstract of JP 05 230764 published Sep. 7, 1993.
Derwent Abstract of JP 60 005179 published Mar. 23, 1985.
Dewent Abstract of JP 07 0102293—published Apr. 18, 1995.
"*Industrial Dyes Chemistry, Properties, Applications*" by Klaus Hunger (ed), Wiley-VCH 2003, pp. 388 to 389.
Batchelor; "*C.I. Generic Name: C.I. Direct Violet 51*", Colour Index International Fingerprints, May 10, 2007.
Solomons, "*Organic Chemistry*", Wiley & Sons, Inc., 5th Edition, 1992, pp. 856-858, 1992.
March, "*Advanced Organic Chemistry, Reactions, Mechanisms and Structure*", Wiley & Sons, Inc., 4th Edition, 1992, pp. 501-506, 1992.
"*C.I. Generic Name: C.I. Acid Blue 205*", ColourIndexInternational, Society of Dyers and Colourists and American Association of Textile Chemists and Colorists, Oct. 20, 2008.

* cited by examiner

*Primary Examiner*—Brian P Mruk
(74) *Attorney, Agent, or Firm*—Rimma Mitelman

(57) ABSTRACT

A laundry treatment composition which comprises a surfactant and from 0.0001 to 0.1 wt % of a combination of dyes which together have a visual effect on the human eye as a single dye having a peak absorption wavelength on cotton of from 540 nm to 650 nm, preferably from 570 mn to 630 mn, the combination comprising a photostable dye which is substantive to cotton.

12 Claims, No Drawings

LAUNDRY TREATMENT COMPOSITIONS CONTAINING A FABRIC SOFTENER AND A BLUE OR VIOLET DYE

This application is a continuation of application Ser. No. 10/561,563, Jun. 8, 2006, now U.S. Pat. No. 7,569,531, issued on Aug. 4, 2009.

TECHNICAL FIELD

The present invention relates to laundry treatment compositions which comprise dye which is substantive to cotton.

BACKGROUND AND PRIOR ART

Dyes have been included in laundry treatment products for many years. Perhaps the oldest use of dyes is to add a substantive coloured dye to coloured clothes which require rejuvenation of colour for example a substantive blue dye for rejuvenation of denim. These compositions usually contain a relatively high concentration of substantive dye. More recently non-substantive dyes have also been used to colour otherwise white laundry detergent compositions. In the case of particulate detergents this has been in the form of so-called speckles to add colour to an otherwise white powder, however laundry detergent powders which are completely blue are also known. When dyes have been included in laundry treatment products in this way it was regarded as essential that non-substantive dyes were used to prevent undesired staining of washed fabrics.

It is also known that a small amount of blue or violet dye impregnated into an otherwise 'white' fabric can appear to have enhanced whiteness as described in Industrial Dyes (K. Hunger ed Wiley-VCH 2003). Modern white fabrics are sold with some dye in their material in order to enhance the whiteness at the point of sale of the garment. This dye is often blue or violet though other colours are used. However once these garments are worn and subsequently washed with a detergent composition the dye is rapidly removed from the fabric often due to dissolution by a surfactant solution. Dye is also lost by reaction with bleach in the wash and fading due to light. This results in a gradual loss of whiteness in addition to any other negative whiteness effects such as soiling. In many cases this leads to the appearance of a yellow colour on the cloth.

Accordingly, the present invention provides a laundry treatment composition according to claim 1.

DETAILED DESCRIPTION OF INVENTION

Unless otherwise stated, all percentages or parts are on a weight basis.

Laundry Treatment Compositions

The present invention relates to compositions which are used to treat laundry items such as clothes. Such compositions are preferably laundry detergent compositions used for washing (especially particulate detergents, liquid detergents, laundry bars, pastes, gels or tablets), laundry fabric conditioners used for softening fabrics, pre-treatment products, post-treatment products, tumble dryer products, ironing products etc. Preferably they are laundry treatment products which are applied in an aqueous environment.

The dyes may be incorporated into the treatment products in a wide variety of ways. For example dyes which are not sensitive to heat may be included in the slurry which is to be spray dried when the treatment product is a particulate detergent composition. Another way of incorporating dyes into particulate detergent products is to add them to granules which are post-added to the main detergent powder. In this case there may be a concentration of dye in the granules which could present the danger of spotting and dye damage on the clothes to be treated. This can be avoided if the concentration of dye in the granules is less than 0.1%. For liquid products the dyes are simply added to the liquid and blended in substantially homogeneously.

Because the dyes are substantive, only a small amount is required to provide the enhanced whiteness effect hence preferably the treatment composition comprises from 0.0001 to 0.1 wt %, preferably from 0.0005 to 0.05 wt % of the dye, more preferably from 0.001 to 0.01 wt %, most preferably from 0.002 to 0.008 wt %.

The Dyes

The photostable dyes of the present invention are unusual in that they are substantive to cotton. It is preferred that the dye has a substantivity to cotton in a standard test of greater than 7%, preferably from 8 to 80%, more preferably from 10 to 60%, most preferably from 15 to 40%, wherein the standard test is with a dye concentration such that the solution has an optical density of approximately 1 (5 cm pathlength) at the maximum absorption of the dye in the visible wavelengths (400-700 nm), a surfactant concentration of 0.3 g/L and under wash conditions of a liquor to cloth ratio of 45:1, temperature of 20° C., soak times of 45 minutes, agitation time of 10 minutes. Higher substantivities are preferred as this means less dye must be added to the formulation to achieve the effect. This is preferred for reasons of cost and also because excess levels of dye in the formulation can lead to an unacceptable level of dye colour in the wash liquor and also in the powder.

A photostable dye is a dye which does not quickly photodegrade in the presence of natural summer sunlight. A photostable dye in the current context may be defined as a dye which, when on cotton, does not degrade by more than 10% when subjected to 1 hour of irradiation by simulated Florida sunlight (42 $W/m^2$ in UV and 343 $W/m^2$ in visible).

It is preferable that the dyes have a blue and/or violet shade. This can mean that the peak absorption frequency of the dyes absorbed on the cloth lies within the range of from 540 nm to 650 nm, preferably from 570 nm to 630 nm. This effect can advantageously be achieved by a combination of dyes, each of which not necessarily having a peak absorption within these preferred ranges but together produce an effect on the human eye which is equivalent to a single dye with a peak absorption within one of the preferred ranges.

Organic dyes are described in Industrial Dyes (K. Hunger ed Wiley-VCH 2003). A compilation of available dyes is the Colour Index published by Society of Dyer and Colourists and American Association of Textile Chemists and Colorists 2002 (see http://www.colour-index.org). Suitable dyes for the current application may be taken from any of the chromophore types, e.g. azo, anthraquinone, triarylmethane, methine quinophthalone, azine, oxazine thiazine. It is preferred that the dye does not contain a reactive group such as found in procion and remazol dyes. Due to the wider range available azo, anthraquinone and triarylmethane dyes are preferred. Azo dyes are especially preferred.

Dyes are conventionally defined as being reactive, disperse, direct, vat, sulphur, cationic, acid or solvent dyes. For the purposes of the present invention, acid and/or direct dyes are preferred.

For use in products which contain predominately anionic surfactants, dyes containing acid groups are preferred. For use in products which contain predominantly cationic surfactants, dyes containing basic groups are preferred. This is to prevent precipitation between the dye and surfactant.

Suitable dyes for use in products containing predominately anionic surfactants include those listed in the Colour Index as Direct Violet Dyes (e.g. Direct Violet 1-108), Direct Blue dyes, Acid Blue and Acid Violet dyes.

Suitable dyes for use in products containing predominately cationic surfactants include those listed in the Colour Index as Basic Blue and Basic Violet Dyes.

To avoid shade changes caused by pick or loss of a proton it is preferred that the dye does not have a pKa or pKb at or near the pH of the product. Most preferably no pKa or pKb in the pH range of from 7 to 11.

It is preferred that the dye has a high extinction coefficient, so that a small amount of dye gives a large amount of colour. Preferably the extinction coefficient at the maximum absorption of the dye is greater than 1000 $mol^{-1}$ L $cm^{-1}$, preferably greater than 10,000 $mol^{-1}$ L $cm^{-1}$, more preferably greater than 50,000 $mol^{-1}$ L $cm^{-1}$.

Suitable dyes can be obtained from any major supplier such as Clariant, Ciba Speciality Chemicals, Dystar, Avecia or Bayer.

Laundry Detergent Compositions

Detergent-active compounds (surfactants) may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch. The preferred detergent-active compounds that can be used are soaps and synthetic non-soap anionic and nonionic compounds. The total amount of surfactant present is suitably within the range of from 5 to 60 wt %, preferably from 5 to 40 wt %.

Anionic surfactants are well-known to those skilled in the art. Examples include alkylbenzene sulphonates, particularly linear alkylbenzene sulphonates having an alkyl chain length of $C_8$-$C_{15}$; primary and secondary alkylsulphates, particularly $C_8$-$C_{20}$ primary alkyl sulphates; alkyl ether sulphates; olefin sulphonates; alkyl xylene sulphonates; dialkyl sulphosuccinates; and fatty acid ester sulphonates. Sodium salts are generally preferred. Nonionic surfactants that may be used include the primary and secondary alcohol ethoxylates, especially the $C_8$-$C_{20}$ aliphatic alcohols ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkanolamides, alkylpolyglycosides, glycerol monoethers, and polyhydroxyamides (glucamide).

Cationic surfactants that may be used include quaternary ammonium salts of the general formula $R_1R_2R_3R_4N^+X^-$ wherein the R groups are long or short hydrocarbyl chains, typically alkyl, hydroxyalkyl or ethoxylated alkyl groups, and X is a solubilising anion (for example, compounds in which $R_1$ is a $C_8$-$C_{22}$ alkyl group, preferably a $C_8$-$C_{10}$ or $C_{12}$-$C_{14}$ alkyl group, $R_2$ is a methyl group, and $R_3$ and $R_4$, which may be the same or different, are methyl or hydroxyethyl groups); and cationic esters (for example, chorine esters).

Amphoteric and zwitterionic surfactants that may be used include alkyl amine oxides, betaines and sulphobetaines. In accordance with the present invention, the detergent surfactant (a) most preferably comprises an anionic sulphonate or sulphonate surfactant optionally in admixture with one or more cosurfactants selected from ethoxylated nonionic surfactants, non-ethoxylated nonionic surfactants, ethoxylated sulphate anionic surfactants, cationic surfactants, amine oxides, alkanolamides and combinations thereof.

Surfactants are preferably present in a total amount of from 5 to 60 wt %, more preferably from 10 to 40 wt %.

Laundry detergent compositions of the present invention preferably contain a detergency builder, although it is conceivable that formulations without any builder are possible.

Laundry detergent compositions of the invention suitably contain from 10 to 80%, preferably from 15 to 70% by weight, of detergency builder. Preferably, the quantity of builder is in the range of from 15 to 50% by weight.

Preferably the builder is selected from zeolite, sodium tripolyphosphate, sodium carbonate, sodium citrate, layered silicate, and combinations of these.

The zeolite used as a builder may be the commercially available zeolite A (zeolite 4A) now widely used in laundry detergent powders. Alternatively, the zeolite may be maximum aluminium zeolite P (zeolite MAP) as described and claimed in EP 384 070B (Unilever), and commercially available as Doucil (Trade Mark) A24 from Ineos Silicas Ltd, UK.

Zeolite MAP is defined as an alkali metal aluminosilicate of zeolite P type having a silicon to aluminium ratio not exceeding 1.33, preferably within the range of from 0.90 to 1.33, preferably within the range of from 0.90 to 1.20. Especially preferred is zeolite MAP having a silicon to aluminium ratio not exceeding 1.07, more preferably about 1.00. The particle size of the zeolite is not critical. Zeolite A or zeolite MAP of any suitable particle size may be used.

Also preferred according to the present invention are phosphate builders, especially sodium tripolyphosphate. This may be used in combination with sodium orthophosphate, and/or sodium pyrophosphate.

Other inorganic builders that may be present additionally or alternatively include sodium carbonate, layered silicate, amorphous aluminosilicates.

Organic builders that may be present include polycarboxylate polymers such as polyacrylates and acrylic/maleic copolymers; polyaspartates; monomeric polycarboxylates such as citrates, gluconates, oxydisuccinates, glycerol mono- di- and trisuccinates, carboxymethyloxysuccinates, carboxymethyloxymalonates, dipicolinates, hydroxyethyl-iminodiacetates, alkyl- and alkenylmalonates and succinates; and sulphonated fatty acid salts.

Organic builders may be used in minor amounts as supplements to inorganic builders such as phosphates and zeolites. Especially preferred supplementary organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %. Builders, both inorganic and organic, are preferably present in alkali metal salt, especially sodium salt, form.

As well as the surfactants and builders discussed above, the compositions may optionally contain bleaching components and other active ingredients to enhance performance and properties.

These optional ingredients may include, but are not limited to, any one or more of the following: soap, peroxyacid and persalt bleaches, bleach activators, sequestrants, cellulose ethers and esters, other antiredeposition agents, sodium sulphate, sodium silicate, sodium chloride, calcium chloride, sodium bicarbonate, other inorganic salts, proteases, lipases, cellulases, amylases, other detergent enzymes, fluorescers, photobleaches, polyvinyl pyrrolidone, other dye transfer inhibiting polymers, foam controllers, foam boosters, acrylic and acrylic/maleic polymers, citric acid, soil release polymers, fabric conditioning compounds, coloured speckles and perfume.

Detergent compositions according to the invention may suitably contain a bleach system. The bleach system is preferably based on peroxy bleach compounds, for example, inorganic persalts or organic peroxyacids, capable of yielding hydrogen peroxide in aqueous solution. Suitable peroxy bleach compounds include organic peroxides such as urea peroxide, and inorganic persalts such as the alkali metal perborates, percarbonates, perphosphates, persilicates and persulphates. Preferred inorganic persalts are sodium perborate monohydrate and tetrahydrate, and sodium percarbonate. Especially preferred is sodium percarbonate having a protective coating against destabilisation by moisture. Sodium percarbonate having a protective coating comprising sodium metaborate and sodium silicate is disclosed in GB 2 123 044B (Kao).

The peroxy bleach compound is suitably present in an amount of from 5 to 35 wt %, preferably from 10 to 25 wt %.

The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED). Also of interest are peroxybenzoic acid precursors, in particular, N,N,N-trimethylammonium toluoyloxy benzene sulphonate.

A bleach stabiliser (heavy metal sequestrant) may also be present. Suitable bleach stabilisers include ethylenediamine tetraacetate (EDTA) and the polyphosphonates such as Dequest (Trade Mark), EDTMP.

Although, as previously indicated, in one preferred embodiment of the invention enzymes are preferably absent, in other embodiments detergent enzymes may be present. Suitable enzymes include the proteases, amylases, cellulases, oxidases, peroxidases and lipases usable for incorporation in detergent compositions.

In particulate detergent compositions, detergency enzymes are commonly employed in granular form in amounts of from about 0.1 to about 3.0 wt %. However, any suitable physical form of enzyme may be used in any effective amount.

Antiredeposition agents, for example cellulose esters and ethers, for example sodium carboxymethyl cellulose, may also be present.

The compositions may also contain soil release polymers, for example sulphonated and unsulphonated PET/POET polymers, both end-capped and non-end-capped, and polyethylene glycol/polyvinyl alcohol graft copolymers such as Sokolan (Trade Mark) HP22. Especially preferred soil release polymers are the sulphonated non-end-capped polyesters described and claimed in WO 95 32997A (Rhodia Chimie).

Powder detergent composition of low to moderate bulk density may be prepared by spray-drying a slurry, and optionally postdosing (dry-mixing) further ingredients.

"Concentrated" or "compact" powders may be prepared by mixing and granulating processes, for example, using a high-speed mixer/granulator, or other non-tower processes.

Tablets may be prepared by compacting powders, especially "concentrated" powders.

Fabric Conditioners

Cationic softening material is preferably a quaternary ammonium fabric softening material.

The quaternary ammonium fabric softening material compound has two C12-28 alkyl or alkenyl groups connected to the nitrogen head group, preferably via at least one ester link. It is more preferred if the quaternary ammonium material has two ester links present.

Preferably, the average chain length of the alkyl or alkenyl group is at least $C_{14}$, more preferably at least $C_{16}$. Most preferably at least half of the chains have a length of $C_{18}$.

It is generally preferred if the alkyl or alkenyl chains are predominantly linear.

The first group of cationic fabric softening compounds for use in the invention is represented by formula (I):

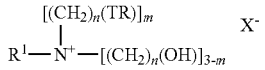

(I)

wherein each R is independently selected from a $C_{5-35}$ alkyl or alkenyl group, $R^1$ represents a $C_{1-4}$ alkyl, $C_{2-4}$ alkenyl or a $C_{1-4}$ hydroxyalkyl group, T is

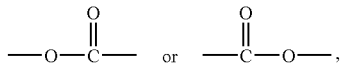

n is 0 or a number selected from 1 to 4, m is 1, 2 or 3 and denotes the number of moieties to which it relates that pend directly from the N atom, and $X^-$ is an anionic group, such as halides or alkyl sulphates, e.g. chloride, methyl sulphate or ethyl sulphate.

Especially preferred materials within this formula are dialkenyl esters of triethanol ammonium methyl sulphate. Commercial examples include Tetranyl AHT-1 (di-hardened oleic ester of triethanol ammonium methyl sulphate 80% active), AT-1 (di-oleic ester of triethanol ammonium methyl sulphate 90% active), L5/90 (palm ester of triethanol ammonium methyl sulphate 90% active), all ex Kao. Other unsaturated quaternary ammonium materials include Rewoquat WE15 ($C_{10}$-$C_{20}$ and $C_{16}$-$C_{18}$ unsaturated fatty acid reaction products with triethanolamine dimethyl sulphate quaternised 90% active), ex Witco Corporation.

The second group of cationic fabric softening compounds for use in the invention is represented by formula (II):

Formula (II)

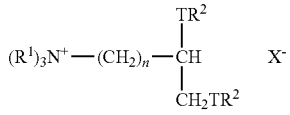

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; n is 0 or an integer from 1 to 5 and T and $X^-$ are as defined above.

Preferred materials of this class such as 1,2bis[tallowoyloxy]-3-trimethylammonium propane chloride and 1,2-bis

[oleyloxy]-3-trimethylammonium propane chloride and their method of preparation are, for example, described in U.S. Pat. No. 4,137,180 (Lever Brothers), the contents of which are incorporated herein. Preferably these materials also comprise small amounts of the corresponding monoester, as described in U.S. Pat. No. 4,137,180.

A third group of cationic fabric softening compounds for use in the invention is represented by formula (III):

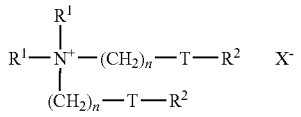

(III)

wherein each $R^1$ group is independently selected from $C_{1-4}$ alkyl, or $C_{2-4}$ alkenyl groups; and wherein each $R^2$ group is independently selected from $C_{8-28}$g alkyl or alkenyl groups; n is 0 or an integer from 1 to 5 and T and $X^-$ are as defined above.

A fourth group of cationic fabric softening compounds for use in the invention is represented by formula (IV):

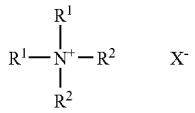

(IV)

wherein each $R^1$ group is independently selected from $C_{1-4}$ alkyl, or $C_{2-4}$ alkenyl groups; and wherein each $R^2$ group is independently selected from $C_8$-$C_{28}$ alkyl or alkenyl groups; and $X^-$ is as defined above.

The iodine value of the parent fatty acyl compound or acid from which the cationic softening material is formed is from 0 to 140, preferably from 0 to 100, more preferably from 0 to 60.

It is especially preferred that the iodine value of the parent compound is from 0 to 20, e.g. 0 to 4. Where the iodine value is 4 or less, the softening material provides excellent softening results and has improved resistance to oxidation and associated odour problems upon storage.

When unsaturated hydrocarbyl chains are present, it is preferred that the cis:trans weight ratio of the material is 50:50 or more, more preferably 60:40 or more, most preferably 70:30 or more, e.g. 85:15 or more.

The iodine value of the parent fatty acid or acyl compound is measured according to the method set out in respect of parent fatty acids in WO-A1-01/46513.

The softening material is preferably present in an amount of from 1 to 60% by weight of the total composition, more preferably from 2 to 40%, most preferably from 3 to 30% by weight.

The composition optionally comprises a silicone. Typical silicones for use in the compositions of the present invention are siloxanes which have the general formula $R_aSiO_{(4-a)/2}$ wherein each R is the same or different and is selected from hydrocarbon and hydroxyl groups, 'a' being from 0 to 3. In the bulk material, 'a' typically has an average value of from 1.85-2.2.

The silicone can have a linear or cyclic structure. It is particularly preferred that the silicone is cyclic as it is believed that cyclic silicones deliver excellent faster drying characteristics to fabrics.

Preferably, the silicone is a polydi-$C_{1-6}$alkyl siloxane.

Particularly preferred is polydimethyl siloxane. The siloxane is preferably end-terminated, if linear, either by a tri-$C_{1-6}$ alkylsilyl group (e.g. trimethylsilyl) or a hydroxy-di-$C_{1-6}$ alkylsilyl group (e.g. hydroxy-dimethylsilyl) groups, or by both.

More preferably the silicone is a cyclic polydimethyl siloxane.

Suitable commercially available silicones include DC245 (polydimethylcyclopentasiloxane also known as D5), DC246 (polydimethylcyclohexasiloxane also known as D6), DC1184 (a pre-emulsified polydimethylpentasiloxane also known as L5) and DC347 (a pre-emulsified 100 cSt PDMS fluid) all ex Dow Corning.

The silicone may be received and incorporated into the composition either directly as an oil or pre-emulsified.

Pre-emulsification is typically required when the silicone is of a more viscous nature.

Suitable emulsifiers include cationic emulsifiers, nonionic emulsifiers or mixtures thereof.

The reference to the viscosity of the silicone denotes either the viscosity before emulsification when the silicone is provided as an emulsion for incorporation into the fabric conditioning composition or the viscosity of the silicone itself when provided as an oil for incorporation into the fabric conditioning composition.

The silicone preferably has a viscosity (as measured on a Brookfield RV4 viscometer at 25° C. using spindle No. 4 at 100 rpm) of from 1 cSt to less than 10,000 centi-Stokes (cSt), preferably from 1 cSt to 5,000 cSt, more preferably from 2 cSt to 1,000 cSt and most preferably 2 cSt to 100 cSt.

It has been found that drying time can be reduced using silicones having a viscosity of from 1 to 500,000 cSt. However, it is most preferred that the viscosity is from 1 to less than 10,000 cSt.

The silicone active ingredient is preferably present at a level of from 0.5 to 20%, more preferably from 1 to 12%, most preferably from 2 to 8% by weight, based on the total weight of the composition.

Optionally and advantageously, one or more un-alkoxylated fatty alcohols are present in fabric conditioners of the present invention.

Preferred alcohols have a hydrocarbyl chain length of from 10 to 22 carbon atoms, more preferably 11 to 20 carbon atoms, most preferably 15 to 19 carbon atoms.

The fatty alcohol may be saturated or unsaturated, though saturated fatty alcohols are preferred as these have been found to deliver greater benefits in terms of stability, especially low temperature stability.

Suitable commercially available fatty alcohols include tallow alcohol (available as Hydrenol S3, ex Sidobre Sinnova, and Laurex CS, ex Clariant).

The fatty alcohol content in the compositions is from 0 to 10% by weight, more preferably from 0.005 to 5% by weight, most preferably from 0.01 to 3% by weight, based on the total weight of the composition.

It is particularly preferred that a fatty alcohol is present if the composition is concentrated, that is if more than 8% by weight of the cationic softening agent is present in the composition.

It is preferred that the compositions further comprise a nonionic surfactant. Typically these can be included for the purpose of stabilising the compositions.

Suitable nonionic surfactants include addition products of ethylene oxide and/or propylene oxide with fatty alcohols, fatty acids and fatty amines.

Any of the alkoxylated materials of the particular type described hereinafter can be used as the nonionic surfactant.

Suitable surfactants are substantially water soluble surfactant the general formula:

$$R—Y—(C_2H_4O)_z—C_2H_4OH$$

where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 14 to 18 carbon atoms.

In the general formula for the alkoxylated nonionic surfactant, Y is typically:

$$—O—, —C(O)O—, —C(O)N(R)— \text{ or } —C(O)N(R)R—$$

in which R has the meaning given above or can be hydrogen; and Z is preferably from 8 to 40, more preferably from 10 to 30, most preferably from 11 to 25, e.g. 12 to 22.

The level of alkoxylation, Z, denotes the average number of alkoxy groups per molecule.

Preferably the nonionic surfactant has an HLB of from about 7 to about 20, more preferably from 10 to 18, e.g. 12 to 16.

Examples of nonionic surfactants follow. In the examples, the integer defines the number of ethoxy (EO) groups in the molecule.

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are $C_{18}$ EO(10); and $C_{18}$ EO(11). The ethoxylates of mixed natural or synthetic alcohols in the "tallow" chain length range are also useful herein. Specific examples of such materials include tallow alcohol-EO(11), tallow alcohol-EO(18), and tallow alcohol-EO (25), coco alcohol-EO(10), coco alcohol-EO (15), coco alcohol-EO(20) and coco alcohol-EO(25).

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful viscosity and/or dispersibility modifiers in the context of this invention. Exemplary ethoxylated secondary alcohols useful herein as the viscosity and/or dispersibility modifiers of the compositions are: $C_{16}$ EO(11); $C_{20}$ EO(11); and $C_{16}$ EO(14).

As in the case of the alcohol alkoxylates, the hexa- to octadeca-ethoxylates of alkylated phenols, particularly monohydric alkylphenols, having an HLB within the range recited herein are useful as the viscosity and/or dispersibility modifiers of the instant compositions. The hexa- to octadeca-ethoxylates of p-tri-decylphenol, m-pentadecylphenol, and the like, are useful herein. Exemplary ethoxylated alkylphenols useful as the viscosity and/or dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

The alkenyl alcohols, both primary and secondary, and alkenyl phenols corresponding to those disclosed immediately hereinabove can be ethoxylated to an HLB within the range recited herein and used as the viscosity and/or dispersibility modifiers of the instant compositions.

Branched chain primary and secondary alcohols which are available from the well-known "OXO" process can be ethoxylated and employed as the viscosity and/or dispersibility modifiers of compositions herein.

Suitable polyol based surfactants include sucrose esters such sucrose monooleates, alkyl polyglucosides such as stearyl monoglucosides and stearyl triglucoside and alkyl polyglycerols.

The above nonionic surfactants are useful in the present compositions alone or in combination, and the term "nonionic surfactant" encompasses mixed nonionic surface active agents.

The nonionic surfactant is present in an amount from 0.01 to 10%, more preferably 0.1 to 5%, most preferably 0.35 to 3.5%, e.g. 0.5 to 2% by weight, based on the total weight of the composition.

The fabric conditioner compositions of the invention preferably comprise one or more perfumes.

It is well known that perfume is provided as a mixture of various components. Suitable components for use in the perfume include those described in "Perfume and Flavor Chemicals (Aroma Chemicals) by Steffen Arctander, published by the author 1969 Montclair, N.J. (US), reprinted 1st Apr. 1982 library of Congress Catalog Number 75-91398.

The perfume is preferably present in an amount from 0.01 to 10% by weight, more preferably 0.05 to 5% by weight, most preferably 0.5 to 4.0% by weight, based on the total weight of the composition.

The liquid carrier employed in the instant compositions is at least partly water due to its low cost, relative availability, safety, and environmental compatibility. The level of water in the liquid carrier is more than about 50%, preferably more than about 80%, more preferably more than about 85%, by weight of the carrier. The level of liquid carrier is greater than about 50%, preferably greater than about 65%, more preferably greater than about 70%. Mixtures of water and a low molecular weight, e.g. <100, organic solvent, e.g. a lower alcohol such as ethanol, propanol, isopropanol or butanol are useful as the carrier liquid. Low molecular weight alcohols including monohydric, dihydric (glycol, etc.) trihydric (glycerol, etc.), and polyhydric (polyols) alcohols are also suitable carriers for use in the compositions of the present invention.

Co-active softeners for the cationic surfactant may also be incorporated in an amount from 0.01 to 20% by weight, more preferably 0.05 to 10%, based on the total weight of the composition. Preferred co-active softeners include fatty esters, and fatty N-oxides.

Preferred fatty esters include fatty monoesters, such as glycerol monostearate (hereinafter referred to as "GMS"). If GMS is present, then it is preferred that the level of GMS in the composition is from 0.01 to 10% by weight, based on the total weight of the composition.

The co-active softener may also comprise an oily sugar derivative. Suitable oily sugar derivatives, their methods of manufacture and their preferred amounts are described in WO-A1-01/46361 on page 5 line 16 to page 11 line 20, the disclosure of which is incorporated herein.

It is useful, though not essential, if the compositions comprise one or more polymeric viscosity control agents. Suitable polymeric viscosity control agents include nonionic and cationic polymers, such as hydrophobically modified cellulose ethers (e.g. Natrosol Plus, ex Hercules), cationically modified starches (e.g. Softgel BDA and Softgel BD, both ex Avebe). A particularly preferred viscosity control agent is a copolymer of methacrylate and cationic acrylamide available under the tradename Flosoft 200 (ex SNF Floerger).

Nonionic and/or cationic polymers are preferably present in an amount of 0.01 to 5 wt %, more preferably 0.02 to 4 wt %, based on the total weight of the composition.

Other optional nonionic softeners, bactericides, soil-releases agents may also be incorporated in fabric conditioners of the invention.

The compositions may also contain one or more optional ingredients conventionally included in fabric conditioning compositions such as pH buffering agents, perfume carriers, fluorescers, colourants, hydrotropes, antifoaming agents, antiredeposition agents, polyelectrolytes, enzymes, optical brightening agents, pearlescers, anti-shrinking agents, anti-wrinkle agents, anti-spotting agents, antioxidants, sunscreens, anti-corrosion agents, drape imparting agents, preservatives, anti-static agents, ironing aids and other dyes.

The product may be a liquid or solid. Preferably the product is a liquid which, in its undiluted state at ambient temperature, comprises an aqueous liquid, preferably an aqueous dispersion of the cationic softening material.

When the product is an aqueous liquid, it preferably has a pH of greater than 1.5 and less than 5, more preferably greater than 2 and less than 4.5.

The fabric conditioner composition is preferably used in the rinse cycle of a home textile laundering operation, where, it may be added directly in an undiluted state to a washing machine, e.g. through a dispenser drawer or, for a top-loading washing machine, directly into the drum. Alternatively, it can be diluted prior to use. The compositions may also be used in a domestic hand-washing laundry operation.

EXAMPLES

Example 1

To determine the substantivity of a range of dyes the following experiment was performed. A stock solution of 1.5 g/L of a base washing powder in water was created. The washing powder contained 18% NaLAS, 73% salts (silicate, sodium tri-poly-phosphate, sulphate, carbonate), 3% minors including perborate, fluorescer and enzymes, remainder impurities and water. The solution was divided into 60 ml aliquots and dye added to this to give a solution of optical density of approximately 1 (5 cm pathlength) at the maximum absorption of the dye in the visible lengths, 400-700 nm. The optical density was measured using a UV-visible spectrometer. 1 piece of bleached, non-mercerised, non-fluorescent woven cotton cloth (ex Phoenic Calico) weighing 1.3 g was placed in the solution at room temperature (20° C.). This cloth represents a slightly yellow cotton. The cloth was left to soak for 45 minutes then the solution agitated for 10 mins, rinsed and dried. Following this the optical density of the solution was re-measured and the amount of dye absorbed by the cloth calculated. This experiment was repeated for each dye and 4 replicates were done per dye.

The dyes used and the % deposition is given in table 1. Table 2 gives the maximum extinction coefficient, $\epsilon_{max}$, in the wash solution and the peak absorption wavelength in solution and on cotton. All values are reported to 2 significant figures.

TABLE 1

| Dye | % Deposition |
|---|---|
| Acid Black 1 | 23 |
| Food Black 1 | 0.50 |
| Direct Blue 1 | 48 |
| Direct Violet 51 | 69 |
| Direct Blue 71 | 34 |
| Acid Violet 9 | 2.1 |
| Acid Blue 80 | 6.8 |
| Acid Violet 17 | 18 |
| Acid Red 88 | 47 |
| Acid Red 150 | 33 |

TABLE 2

| Dye | Type | $\epsilon_{max}$ [$mol^{-1}L\ cm^{-1}$] | $\lambda_{max}$ [nm] in solution, on cotton |
|---|---|---|---|
| Acid Black 1 | Azo | 51000 | 620, 630 |
| Food Black 1 | Azo | 41000 | 570, 590 |
| Direct Blue 1 | Azo | 120000 | 600, 640 |
| Direct Violet 51 | Azo | 65000 | 550, 570 |
| Direct Blue 71 | Azo | 120000 | 590, 600 |
| Acid Violet 9 | Triaryl | 46000 | 540 |
| Acid Blue 80 | Anthraquinone | 27000 | 630, 630 |
| Acid Violet 17 | Triaryl | 53000 | 520, 590 |
| Acid Red 88 | Azo | 14400 | 510, 520 |
| Acid Red 150 | Azo | 23600 | 520, 530 |

Example 2

The experiment of example 1 was repeated except the dye level in the wash solution was decreased to $1/10^{th}$, so that the optical density was 0.1 (5 cm path length). Following the washes the Ganz whiteness of the cloth was measured (see "assessment of Whiteness and Tint of Fluorescent Substrates with Good Interinstrument Correlation" *Colour Research and Application* 19, 1994). The results are displayed in table 3, the ganz whiteness values are accurate to +/−5 units. Large increase in the measured Ganz whiteness are found for the substantive blue and violet dyes with $\lambda_{max}$ on cotton in the range 570 to 640.

TABLE 3

| Dye | Ganz whiteness |
|---|---|
| Control | 150 |
| Acid Black 1 | 171 |
| Food Black 1 | 155 |
| Direct Blue 1 | 190 |
| Direct Violet 51 | 208 |
| Direct Blue 71 | 205 |
| Acid Violet 9 | 153 |
| Acid Blue 80 | 152 |
| Acid Violet 17 | 170 |

Acid black 1, direct blue 1, direct violet 51, direct blue 71 and acid violet 17 gave the greatest increase in Ganz whiteness.

Direct violet 51 and direct blue 71 gave a higher Ganz whiteness value than direct blue 1 and they have the further advantage over direct blue 1 that they are not metabolised in the body to give carcinogenic amine, unlike the huge number of direct blue and violet dyes (e.g. direct blue 1) which contain moieties which breakdown to give the carcinogenic benzidine, 3,3'dimethoxybenzidine or 3,3'-dimethylbenzidine.

These dyes also have an advantage over many direct violet dyes which contain transition metals that are hazardous to the environment and to humans.

Preferred direct dyes fall into two groups: The first group comprises tris-azo direct blue dyes based on the structure:

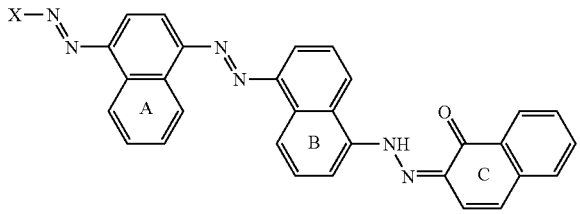

where at least two of the A, B and C napthyl rings are substituted by a sulphonate group. The C ring may be substituted at the 5 position by an $NH_2$ or NHPh group, X is a benzyl or napthyl ring substituted with up to 2 sulphonate groups and may be substituted at 2 position with a OH group and may also be substituted with an $NH_2$ or NHPh group.

Non-limiting examples of these dyes are direct blue 34, 70, 71, 72, 75, 78, 82, 120.

The second group comprises bis-azo direct violet dyes based on the structure

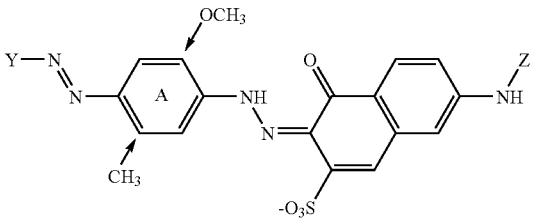

where Z is H or phenyl. The A ring is preferably substituted by a methyl and methoxy group at the positions indicated by arrows. The A ring may also be a naphthyl ring. The Y group is a benzyl or naphthyl ring, which is substituted by sulphate group and may be mono or disubstituted by methyl groups.

Non-limiting examples of these dyes are direct violet 5, 7, 11, 31, 51. The invention also comprises compositions including a single dye of the structure of the first or second group, or mixtures thereof, the dye or mixture having the defined peak absorption wavelength.

Example 3

The experiment of example 1 was repeated except using dyes at lower concentrations, such that the optical density (5 cm) was approximately 0.05 and 0.025 giving faintly coloured wash liquors (i.e. using dye levels 1/20 and $1/40^{th}$ of experiment 1). Following washing and drying the increase in whiteness was measured by a reflectometer and expressed in Ganz units. The Ganz values are accurate to +/−5 units. The results are shown in the Table 3 below.

TABLE 4

| dye | Ganz whiteness OD~0.05 | Ganz whiteness OD~0.025 |
|---|---|---|
| control | 156 | 156 |
| Direct Blue 1 | 163 | 175 |
| Direct Violet 51 | 153 | 184 |
| Direct Blue 71 | 171 | 185 |

Direct blue 71 gave the best results.

Example 4

Example 3 was repeated but using the blue dye Acid Black 1, the red dyes Acid Red 88 and Acid Red 150, and mixtures thereof. The results are shown in the tables below.

TABLE 5

| dye | Ganz whiteness OD~0.05 | Ganz whiteness OD~0.025 |
|---|---|---|
| control | 154 | 154 |
| Acid Black 1 | 160 (A) | 160 (B) |
| Acid Red 88 | 150 (C) | 152 (D) |
| Acid Red 150 | 164 (E) | 160 (F) |

TABLE 6

| Dye Mixture | Ganz whiteness |
|---|---|
| control | 154 |
| (A) + (C) | 173 |
| (A) + (D) | 175 |
| (A) + 0.5(D) | 171 |
| (A) + (E) | 176 |
| (A) + (F) | 175 |
| (A) + 0.5(F) | 169 |

The results show that mixtures of red and blue dyes gives a greater increase in whiteness than either alone. This is because the mixture produces a violet shade.

The invention claimed is:

1. A laundry treatment composition which comprises a surfactant and from 0.0001 to 0.1 wt % of a combination of dyes which together have a visual effect on the human eye as a single dye having a peak absorption wavelength on cotton of from 540 nm to 650 nm, combination comprising a photostable dye which is substantive to cotton, wherein the photostable dye is a cationic dye and is an azo dye.

2. A composition as claimed in claim 1, which is a laundry detergent composition.

3. A composition as claimed in claim 2, wherein the detergent composition is a particulate detergent composition.

4. A composition as claimed in claim 1, which is a laundry fabric conditioner.

5. A composition as claimed in claim 1 wherein the surfactant is a non-soap surfactant.

6. A composition as claimed in claim 5, wherein the surfactant is an anionic or cationic surfactant.

7. A composition as claimed in claim 6, wherein the surfactant is $C_8$-$C_{15}$ linear alkyl benzene sulphonate.

8. A composition as claimed in claim 1, which comprises from 5 to 60 wt % of surfactant.

9. A composition as claimed in claim 1, which comprises fluorescer.

10. A composition as claimed in claim 1, which comprises from 0.0005 to 0.05 wt % of dye.

11. A composition as claimed in claim 1, which comprises from 0.001 to 0.01 wt % of dye.

12. A composition as claimed in claim 1, wherein the peak absorption wavelength on cotton is from 570 mn to 630 mn.

* * * * *